US009506130B2

(12) United States Patent
Fagot

(10) Patent No.: US 9,506,130 B2
(45) Date of Patent: Nov. 29, 2016

(54) CORROSION RESISTANT STEEL FOR MARINE APPLICATIONS

(75) Inventor: Anne Fagot, Esch sur Alzette (LU)

(73) Assignee: ARCELORMITTAL COMMERCIAL RPS S.A.R.L., Esch sur Alzette (LU)

( * ) Notice: Subject to any disclaimer, the term of this patent is extended or adjusted under 35 U.S.C. 154(b) by 501 days.

(21) Appl. No.: 12/747,101

(22) PCT Filed: Dec. 18, 2008

(86) PCT No.: PCT/EP2008/067922
§ 371 (c)(1),
(2), (4) Date: Jun. 9, 2010

(87) PCT Pub. No.: WO2009/080714
PCT Pub. Date: Jul. 2, 2009

(65) Prior Publication Data

US 2010/0266440 A1 Oct. 21, 2010

(30) Foreign Application Priority Data

Dec. 21, 2007 (EP) ..... 07150370

(51) Int. Cl.

| | |
|---|---|
| ***C22C 38/06*** | (2006.01) |
| ***C22C 38/12*** | (2006.01) |
| ***C21D 8/02*** | (2006.01) |
| ***C22C 38/02*** | (2006.01) |
| ***C22C 38/04*** | (2006.01) |
| ***C22C 38/22*** | (2006.01) |
| ***C22C 38/24*** | (2006.01) |
| ***C22C 38/26*** | (2006.01) |

(52) U.S. Cl.
CPC ..... *C22C 38/06* (2013.01); *C21D 8/02* (2013.01); *C21D 8/0226* (2013.01); *C22C 38/02* (2013.01); *C22C 38/04* (2013.01); *C22C 38/12* (2013.01); *C22C 38/22* (2013.01); *C22C 38/24* (2013.01); *C22C 38/26* (2013.01)

(58) Field of Classification Search
CPC ..... C22C 38/02; C22C 38/04; C22C 38/06; C22C 38/12; C22C 38/22; C22C 38/24; C22C 38/26; C21D 8/02; C21D 8/0226
USPC ..... 420/87, 103–105, 110, 111, 127
See application file for complete search history.

(56) References Cited

U.S. PATENT DOCUMENTS

| | | | |
|---|---|---|---|
| 5,470,529 | A | 11/1995 | Nomura et al. |
| 2008/0202639 | A1* | 8/2008 | Tomida et al. ..... 148/506 |

FOREIGN PATENT DOCUMENTS

| | | | |
|---|---|---|---|
| GB | 2392919 | | 3/2004 |
| JP | 07003388 | | 1/1995 |
| JP | 11172368 | | 6/1999 |
| JP | 2001032035 | | 2/2001 |
| JP | 2007197757 | | 8/2007 |
| WO | WO2007015541 | * | 2/2007 |

OTHER PUBLICATIONS

Imamura et al., English machine translation of JP 2007-197757 from IDS, Aug. 2007, p. 1-17.*
Department of the Army, "Field Manual for Pile Construction", Apr. 1985, Department of the Army, p. 1-176.*
"Carbon and Alloy Steels", Modern Steels and Their Properties, 1980, Bethlehem Steel Corporation, p. 19-23.*
International Search Report; PCT/EP2008/067922; Mar. 9, 2009.

* cited by examiner

*Primary Examiner* — Roy King
*Assistant Examiner* — Caitlin Kiechle
(74) *Attorney, Agent, or Firm* — Cantor Colburn LLP

(57) ABSTRACT

A steel, namely for marine applications, comprises by weight percent: carbon: 0.05 to 0.20; silicon: 0.15 to 0.55; manganese: 0.60 to 1.60; chromium: 0.75 to 1.50; aluminum: 0.40 to 0.80; niobium and/or vanadium: 0.01<[Nb]+[V]<0.60; sulphur: up to 0.045; and phosphorous: up to 0.045.

22 Claims, No Drawings

CORROSION RESISTANT STEEL FOR MARINE APPLICATIONS

TECHNICAL FIELD

The present invention generally relates to corrosion resistant steels and products of such steels. The invention relates especially, but not exclusively, to corrosion resistant steels for products for use in marine applications. These products include inter alia sheet piling, bearing piles, combined walls, etc, which in use are immersed in seawater.

BACKGROUND

Steel sheet piles have been used since the beginning of the $20^{th}$ century in the construction of quays and harbours, locks and moles, protection of riverbanks as well as excavations on land and in water, and, in general, excavation work for bridge abutments, retaining walls, foundation structures, etc.

In addition to plain sheet pile walls, sheet piles can easily be used as infill sheeting between king piles to build up combined walls (or "combi-walls"), for the construction of deep quay walls with high resistance to bending. King piles are typically either wide flange beams or cold formed welded tubes. The infill sheeting are connected to the king piles by interlocking bars (connectors).

The design of a sheet pile wall and more generally of a steel combined wall is governed by the loads acting thereon, which include applied forces from soils, water and surface surcharges. Mechanical performance of the structural elements like sheet piles and tubes is thus a primary parameter.

Another essential aspect to be considered in a combined wall design is durability. The lifetime of sheet pile structures will clearly be strongly influenced by environmental factors. Those working in a marine environment are aware that corrosion is one of the most important factors to consider in the long-term life of a structure.

Indeed, chlorides found in marine environments stimulate the corrosion process and are the principal reason for the more aggressive attacks on steel. Wind and waves combine to provide oxygen and moisture for an electro-chemical reaction and abrasion may remove any protection rust film. It may however be noted that not all salt-water environments are dangerously aggressive to steel, and not all zones along the height of the piling structure are attacked at the same rate.

In fact, the seaside portion of the sheet piling wall is exposed to six "zones"—atmospheric, splash (the atmospheric zone just above the high tide), tidal, low water, immersion and soil. The corrosion rate in each of these zones varies considerably. Generally, experience has shown that steel sheet piling in coastal marine environments have the highest corrosion rates in the splash (just above mean high water) and low water (just below mean low water) zones, corrosion rates in the atmospheric and soil areas are considered to be negligible on such piling structures.

Effects of corrosion in marine environments can be accounted for by a sacrificial steel reserve and/or protective methods (paintings, cathodic protection). However, a protective painting or concrete layer can only be applied on the non-immersed zones of the steel structure.

The addition of certain alloy elements to carbon steel also provides improved performances in some environments. As early as 1913, experimental work by the steel industry indicated that small amounts of copper would enhance the atmospheric corrosion resistance of carbon steel.

In the 1960s, the so-called "Mariner" grade was developed, and is today a well-known alternative to carbon steel for sheet piles for marine environments. ASTM standard A690 gives the chemical composition of this high strength, low alloy (HSLA) steel, which contains higher levels of copper (0.08-0.11 wt. %), nickel (0.4-0.5 wt. %) and phosphorous (0.08-0.11 wt. %) than typical carbon structural steels. Tests indicated a substantially improved corrosion resistance to seawater corrosion in the splash zone of exposed marine structures than typical carbon structural steels.

Also concerned by steel corrosion in marine environment, Corus UK, Ltd. filed a patent application on Dec. 9, 2002, published as GB 2 392 919, relating to a CrAlMo corrosion resistant steel for the production of sheet piling for marine applications. The following steel composition (by weight percent) is disclosed: carbon 0.05-0.25; silicon up to 0.60; manganese 0.80-1.70; chromium 0.75-1.50; molybdenum 0.20-0.50; aluminium 0.40-0.80; titanium up to 0.05; phosphorous up to 0.045; sulphur up to 0.045; balance iron and incidental and/or residual impurities. The aim followed by Corus was to provide a weldable corrosion resistant steel, that is especially resistant to seawater, and having following mechanical properties:

- minimum yield stress of about 355 MPa;
- minimum tensile strength of about 480 MPa;
- minimum Charpy absorbed impact energy of 27 J at a test temperature of 0° C.

Unfortunately, this CrAlMo steel designed for sheet piling products was never manufactured on industrial scale due to initial difficulties faced up in the continuous casting process as well as some insufficient mechanical properties. Further, tests results known to the present applicant on the above steel did not permit to achieve the alleged mechanical performances. In particular, the above CrAlMo steel showed low toughness and ductility.

It may be noted that a variety of studies and tests have been carried out in the past to determine the effects of alloy elements on the anti-corrosion properties of low alloy steels. While in general authors of such studies would observe some tendencies in the effect of a certain alloy element, with respect to a given corrosion zone and over a given period of time, conclusions were always moderate. Besides, there are many contradictory results.

As a general rule, it has to be kept in mind that the relationship between anti-corrosion properties of steel in marine environment and alloy elements is considerably different with variation of marine environment. As it is known in the art, the same alloy element's effect on the anti-corrosion of steel in the splash and immersion zones can be clearly different. In fact, a given alloy element can improve the corrosion resistance of steel in one zone, but not in another zone, or even accelerate the corrosion rate in that other zone. Further, it has been observed that whereas an increase in chromium, for example, may initially improve corrosion resistance, after a certain period of time the situation may be reversed. Also, some synergistic effects may exist between alloying elements, such synergistic effect depending of course on the concentrations, but generally not varying linearly with the concentrations.

Another type of corrosion to which metallic structures may be subject is the so-called "galvanic corrosion". Galvanic corrosion is defined as the accelerated corrosion of a metal due to electrical contact with a more passive metal in an electrolyte. Higher electric conductivity of seawater facilitates such type of corrosion between two different types of metals that can be found in a metal structure. Hence, when designing combined walls, care should be taken not to connect carbon steel structural elements with others made of micro-alloyed steel.

More recently, attention has been drawn to a further source of corrosion generally designated as microbiologically influenced corrosion (MIC). Indeed, it has lately been proved that such a type of localized corrosion was occurring in the low water zone on steel structures in marine environment. This phenomenon is known as Accelerated Low Water Corrosion (ALWC) and is responsible for extremely high rates of corrosion.

From the above it appears that numerous factors have to be considered in the construction of combined walls in marine environments. The selected steels for the different structural elements must meet the required mechanical performances, but at the same time it is desirable that the steel has improved corrosion resistance to seawater.

Although addition of certain alloying elements can be helpful to improve corrosion resistance, it should not compromise the mechanical performances. Alloying of carbon steel must thus be made carefully to achieve desired strength and toughness, enhance resistance to corrosion in one or more zones, while not accelerating corrosion in the others, and bearing weldability and costs issues in mind.

In practice, although the acute corrosion of steel in marine environments has been a matter of concern since the 1950s, it has to be noted that the vast majority of sheet piles and tubes for use in marine environment manufactured nowadays are made from plain carbon steel.

BRIEF SUMMARY

The disclosure seeks to provide a corrosion resistant steel that especially provides improved corrosion resistance to seawater and gives adequate mechanical performances of the concerned steel products for construction of combined walls and other structures in marine environment.

The present invention in fact derives from the idea that, to increase lifetime and simplify maintenance of sheet pile structures and more generally steel combined walls in marine environment, it would be desirable to dispose of a single steel (chemical) composition suitable for the manufacture of the different structural elements. In this connection it is recalled that combined walls are conventionally manufactured from tubes and sheet piles complying with different standards, which implies varying requirements on the chemical compositions of the structural elements.

Using a same steel for manufacturing the structural elements like tubes or wide flange beams, sheet piles and connectors of a combined wall alleviates problems of galvanic corrosion between connected structural members. Further, corrosion will progress uniformly through the structure, for same zones.

Still with respect to maintenance, the present inventors aimed to develop a steel composition having at least improved corrosion resistance in the immersion zone. This has been decided in order to facilitate maintenance of combined walls or sheet piling walls. Indeed, maintenance of submerged regions of steel structures is obviously less convenient than for the atmospheric or splash zone, the submerged zone being always under water.

A difficulty in developing such steel is thus the sum of parameters that have to be taken into account, plus the fact that sheet piles and tubes come from different manufacturing routes, each having their own manufacturing methods, facilities and know-how, in particular with respect to the steel compositions they can handle. While developing the present invention, the inventors have taken into account numerous parameters: mechanical performance (strength and toughness, microstructure); corrosion resistance, especially to seawater in immersed zone; weldability; industrial feasibility, considering that the steel composition must be suitable for use in production routes for long and flat products; and last but not least, costs.

DETAILED DESCRIPTION

According to the present invention, a steel is proposed, which comprises iron and, by weight percent:

Carbon: 0.05 to 0.20;
Silicon: 0.15 to 0.55;
Manganese: 0.60 to 1.60;
Chromium: 0.75 to 1.50;
Aluminum: 0.40 to 0.80;
Niobium and/or vanadium: $0.01 \leq [Nb]+[V] \leq 0.60$;
Sulphur: up to 0.045; and
Phosphorous: up to 0.045.

Preferably, the balance is iron and incidental and/or residual impurities. However, the steel may further comprise other elements.

It shall be appreciated that the micro-alloyed steel of the invention has an improved corrosion resistance, especially to seawater, over conventional carbon steel, i.e. the corrosion rate in the immersed zone is reduced. Enhanced corrosion resistance in the immersion zone is particularly advantageous since submerged regions cannot be protected by a paint or concrete capping.

Although not willing to be bound by theory, it may be noted that improved corrosion resistance results from an adherent and compact layer that forms in the submerged and low water zones. This layer is enriched in microalloying elements and acts as a barrier for oxygen, required for uniform corrosion to occur.

It shall also be appreciated that the present steel composition has improved corrosion resistance to the MIC, especially ALWC.

As combined walls are to be driven into the soil using an impact hammer or a vibrodriver, the various components should resist to the stresses generated during the installation. In this connection, it may be appreciated that a further advantageous aspect of the present steel is toughness and ductility at high stress level (translated by elongation at fracture A).

This improved corrosion resistance does not sacrifice on mechanical performances, as the following performances can be attained:

- minimum yield stress of about 355 Mpa for sheet piles and 400 Mpa for tubes; and
- minimum tensile strength of about 480 Mpa for sheet piles and 500 MPa for tubes.

Furthermore, a minimum fracture toughness of 27 J at 0° C. can be ensured with the present composition.

Hence, the present steel permits manufacturing of sheet piles (namely U, Z or H king piles) and connectors having at least mechanical performances of an S355GP grade according to EN10248-1. It also permits manufacturing of tubes having at least mechanical performances of the S420MH grade of EN 10219-1 or X60 of API 5 L standards.

Preferred concentrations (wt. %) for each of the above alloying elements are: Carbon: 0.06 to 0.10; Silicon: 0.16 to 0.45; Manganese: 0.70 to 1.20; Chromium: 0.80 to 1.20; Aluminum: 0.40 to 0.70; Niobium and/or vanadium: $0.01 \leq [Nb]+[V] \leq 0.20$; Sulphur: up to 0.008; Phosphorous: up to 0.020.

Although not willing to be bound by theory, some explanations may be given as to the selection of some elements and their respective amounts.

The present steel composition is based on the synergistic effect of Cr and Al that improves corrosion resistance in the submerged zone. It is also believed that these alloy elements prove particularly efficient against ALWC.

As it is known chromium contributes to strength but is primarily used here for resisting to seawater corrosion. Higher levels of Cr are considered to lead to the reversal of its effect, and the amount of Cr has been selected taking into account the other elements, especially Al. A range of 0.75 to 1.5 wt. % was thus selected.

Whereas in most steel making industries aluminum is used in small amounts (up to 0.05 wt. %) for deoxidation purposes, aluminum is here a major alloy element with chromium. The higher selected range of 0.40 to 0.80 wt. % provides the desired synergistic effect with chromium that permits an enhanced resistance to seawater corrosion and biocorrosion over carbon steel.

A minimum carbon content of 0.05 wt. % was selected to ensure adequate strength. The upper limit on carbon was fixed to 0.20 wt. % for improved weldability of the steel.

Manganese is known to be an effective solid solution strengthening element. A range of 0.60 to 1.60 wt. % was selected as compromise between strength, hardenability and toughness.

The addition of niobium and/or vanadium causes precipitation hardening and grain refinement, and permits to achieve higher yield strength in the hot-rolled condition. Nb or V can be added alone. The combined use of V and Nb in steels with low carbon contents (especially below 0.10 wt. %) reduces the amount of pearlite and improves toughness, ductility and weldability.

Molybdenum may be optionally added to the present steel. An addition of Mo can provide enhanced strength. Nevertheless, a too high amount of Mo can be problematic in the industrial production of combined walls. Further, the effect of Mo was not considered to be particularly efficient with respect to corrosion resistance improvement in the submerged zone. Therefore, the Mo concentration shall be between 0.001 and 0.27 wt. % and is preferably no more than 0.10 wt. %.

Another optional alloy element is titanium, which permits precipitating N and S. To avoid adverse effects, the preferred upper limit on Ti is set to 0.05 wt. %, with a lower limit of 0.001 wt. %.

In this connection, for an improved finishing aspect of long (rolled) products manufactured from the present steel, the nitrogen content is preferably controlled not to exceed 0.005 wt. %, more preferably 0.004 wt. %. This minimizes precipitation of aluminum nitrides that may form during continuous casting and may lead, under some circumstances, to surface imperfections. As it is known to those skilled in the art, various measures can be taken to avoid/limit such effect of nitrogen, either by combining N with known addition elements (Ti, Nb and V have a particular affinity for nitrogen), and/or by taking appropriate measures during continuous casting (e.g. protected stream, etc.).

Steel and steel products in accordance with the present invention may be manufactured using conventional steel making (shaft/blast furnace, basic oxygen, or electric arc furnace) and processing (e.g. hot rolling, cold forming) techniques.

It will be understood that the nature and level of impurities in the steel will depend on the steel-making route. While steel originating from the blast furnace is quite pure, sheet piles are often manufactured from steel originating from electric arc furnaces (i.e. from scrap metal). In the latter case, elements such as copper, nickel or tin, may be present as residual elements at relatively high levels, as it is known to those skilled in the art.

For improved weldability, the carbon equivalent value (CEV) shall preferably be below 0.43, the CEV being calculated in accordance with the following formula:

$$CEV = C + \frac{Mn}{6} + \frac{Cr + Mo + V}{5} + \frac{Ni + Cu}{15}.$$

The steel composition of the invention permits to manufacture steels with a microstructure mainly comprising ferrite and pearlite. Preferably, especially for hot rolled sheet piles, the microstructure comprises ferrite (major phase) and pearlite, e.g. in a 4:1 ratio.

As compared to the CrAlMo steel described in GB 2 392 919, the present steel can actually be industrially manufactured and has superior mechanical performances. In particular, it has a considerable ductility at high stress (expressed by the elongation in tensile test), as required by modern design methods (based on Ultimate Limit State). The present inventor developed a steel having enhanced mechanical performances with good corrosion resistance while using Al and Cr as main alloying elements, while GB 2 392 919 insisted on the use of the three alloying elements Cr, Al and Mo, the latter being added for strength and corrosion resistance.

In particular, the present inventor has observed that molybdenum is not required to achieve the desired performances, a too high molybdenum content even leading to heterogeneities in the microstructure (development of bainite) and problems in the rolling mill. Use of molybdenum also considerably increases production costs.

The present invention also concerns steel products, intermediate steel products and steel structures made from the above steel. Regarding steel structures such as combined walls or sheet pile walls, all individual steel elements are made from a steel falling in the above prescribed ranges, and preferably of the same composition (i.e. with substantially same concentrations for each alloy element).

EXAMPLES

Various compositions of the present steel have been tested in laboratory to mimic the feasibility of an industrial sheet pile. Laboratory hot rolling was carried out with steel samples using usual rolling parameters used in the plant (temperature, reduction).

Samples having a steel composition as listed in Table 1 (remainder being iron and incidental and/or residual impurities) below were manufactured in the laboratory. The mechanical performances of these samples were then tested in order to be compared to the requirements of the standards. Samples B119, B121 and B123 were subjected to a laboratory sheet pile hot rolling. Sample B125 was subjected to rolling simulating steel plate production.

TABLE 1

| Sample | C wt % | Mn wt % | Si wt % | Cr wt % | Al wt % | P wt % | S wt % | Nb wt % | CEV |
|---|---|---|---|---|---|---|---|---|---|
| B119 | 0.074 | 0.76 | 0.22 | 0.96 | 0.55 | 0.02 | 0.014 | 0.022 | 0.39 |
| B121 | 0.077 | 0.76 | 0.23 | 0.95 | 0.54 | 0.02 | 0.014 | 0.070 | 0.39 |

TABLE 1-continued

| Sample | C wt % | Mn wt % | Si wt % | Cr wt % | Al wt % | P wt % | S wt % | Nb wt % | CEV |
|---|---|---|---|---|---|---|---|---|---|
| B123 | 0.077 | 0.74 | 0.47 | 0.96 | 0.55 | 0.021 | 0.014 | 0.024 | 0.39 |
| B125 | 0.079 | 0.78 | 0.25 | 0.97 | 0.58 | 0.02 | 0.008 | 0.024 | 0.39 |

Table 2 in turn gives the resulting mechanical performances of the tested samples, as well as the values prescribed by relevant standards (current standards do not prescribe values of impact resistance). As can be seen samples B119, B121 and B123 have respective yield strength (Rp0.2), tensile strength (TS), and elongation values exceeding those prescribed for a S355GP grade of the European sheet pile standard.

The B125 sample representing a steel tube in the test also exhibits mechanical properties exceeding that of the X60 and S420 MH (with wall thickness between 16 and 40 mm) grades for steel welded tubes. It may be noted that for all samples ductility, indicated by elongation A, is notably above the prescribed value.

TABLE 2

| Sample (or standard) | Tensile tests $Rp_{0,2}$ Mpa | TS Mpa | elongation A5 % | Charpy 0° C. Impact energy J |
|---|---|---|---|---|
| EN 10248-1 S355GP | min. 355 | min. 480 | min. 22 | / |
| B119 | 425 | 501 | 30.5 | 216 |
| B121 | 488 | 550 | 26.6 | 207 |
| B123 | 438 | 525 | 29.6 | 216 |
| B125 | 449 | 576 | 26.6 | |
| API 5L X60 | min. 414 | min. 517 | min. 19 | |
| EN 10219-1 S420MH 16 < T < 40 mm | min. 400 | min. 500-600 | min. 19 | |

Industrial Trials

Tests were also carried out at industrial level, both for sheet piles and tubes. Two trials are reported here below for sheet piles under references AZ18 and AZ26. Slabs were produced by continuous casting. Z-profile (AZ18 and AZ26) sheet piles were then hot rolled from the obtained slabs on an industrial hot rolling mill. Steel analyses on products are reported in Table 3 below (remainder being iron and incidental and/or residual impurities).

TABLE 3

| Sample | C wt % | Mn wt % | Si wt % | Cr wt % | Al wt % | P wt % | S wt % | Nb wt % |
|---|---|---|---|---|---|---|---|---|
| AZ18 | 0.074 | 0.896 | 0.447 | 0.926 | 0.547 | 0.010 | 0.002 | 0.036 |
| AZ26 | 0.081 | 0.890 | 0.433 | 0.879 | 0.551 | 0.013 | <0.003 | 0.038 |

The mechanical performances of these sheet piles are summarized in table 4 (yield strength—ReH, tensile strength—Rm, and elongation—A5d) below, where e indicates the web thickness. For each sheet piles, two samples from the web and flange have been tested. For the resilience test, several samples have been taken and tested at 0 and −20° C., the mean value being indicated in the last column.

TABLE 4

| Sample | e (mm) | Tensile tests ReH Mpa | Rm Mpa | elongation A5 % | Fracture toughness Temperature ° C. | Mean Impact energy J |
|---|---|---|---|---|---|---|
| AZ18a (flange) | 9.5 | 467 | 526 | 28.4 | 0 | 215 |
| | | | | | −20 | 207 |
| AZ18b (web) | 9.5 | 481 | 530 | 25.3 | 0 | 218 |
| | | | | | −20 | 202 |
| AZ18c (flange) | 9.5 | 461 | 517 | 27.7 | 0 | 213 |
| | | | | | −20 | 199 |
| AZ18d (web) | 9.5 | 499 | 552 | 25.1 | 0 | 229 |
| | | | | | −20 | 204 |
| AZ26a (web) | 12.2 | 459 | 520 | 26.0 | 0 | 311 |
| | | | | | −20 | 288 |
| AZ26a (flange) | 12.2 | 417 | 501 | 28.5 | 0 | 304 |
| | | | | | −20 | 287 |
| AZ26b (web) | 12.2 | 433 | 515 | 26.3 | 0 | 321 |
| | | | | | −20 | 260 |
| AZ26b (flange) | 12.2 | 419 | 496 | 27.0 | 0 | 313 |
| | | | | | −20 | 269 |

As it can be seen, these sheet piles are, in terms of mechanical performances, substantially superior to the requirements of S355GP (EN 10248-1).

As it is known in the art, welded tubes are manufactured from steel coils. Coils having the steel composition of table 5 (remainder being iron and incidental and/or residual impurities) have been manufactured under conventional flat-product industrial conditions (continuous casting and hot rolling), and submitted to tensile and fracture toughness testing; the results are reported in table 6 (e being the foil thickness). Although the samples are taken on coils and not from a welded tube, it is generally acknowledged in the art that such tests nevertheless give a good indication of the mechanical performance of a welded tube, the yield stress and tensile strength of the welded tube being slightly lower (a few MPa).

TABLE 5

| Sample | C wt % | Mn wt % | Si wt % | Cr wt % | Al wt % | P wt % | S Wt % | Nb wt % |
|---|---|---|---|---|---|---|---|---|
| C1 | 0.076 | 0.885 | 0.456 | 0.944 | 0.600 | 0.001 | 0.002 | 0.038 |
| C2 | 0.076 | 0.894 | 0.463 | 0.947 | 0.564 | 0.011 | 0.002 | 0.038 |

TABLE 6

| Sample | e (mm) | Tensile tests ReH Mpa | Rm Mpa | elongation A50 % | Fracture toughness Temperature ° C. | Mean Impact energy J |
|---|---|---|---|---|---|---|
| 1Coil 1 | 14 | 495 | 602 | 29 | −10 | 128 |
| Coil 2 | 14 | 487 | 579 | 33 | −10 | 163 |

Again, the values are clearly superior to the requirements of S420 MH (EN 10219-1) or X60. Fracture toughness values obtained are given for information.

Finally C9-type connectors have been industrially produced from blooms with a steel composition as indicated in table 7 (remainder Fe and incidental and/or residual impurities) and submitted to mechanical trials, which are reported in table 8 below.

TABLE 7

| Sample | C Wt % | Mn wt % | Si wt % | Cr Wt % | Al wt % | P wt % | S Wt % | Nb wt % |
|---|---|---|---|---|---|---|---|---|
| C9-(cast) | 0.078 | 0.89 | 0.46 | 0.95 | 0.6 | 0.01 | 0.002 | 0.038 |

TABLE 8

| | Tensile tests | | | Fracture toughness | |
|---|---|---|---|---|---|
| Sample | ReH Mpa | Rm Mpa | Elongation A5 % | Temperature ° C. | Mean Impact energy J |
| C9-1 | 434 | 515 | 26.7 | 0 | 262 |
| C9-2 | 416 | 512 | 27.2 | 0 | 259 |
| C9-3 | 425 | 514 | 27.5 | 0 | 280 |

Corrosion Trials

Initial corrosion tests in laboratory using an accelerated corrosion simulation indicated for all samples an improved corrosion resistance to seawater compared to conventional carbon steel.

Further laboratory trials were carried out in order to simulate corrosion in marine environment on piling structures. Steel samples were exposed to a bacteria-free environment, as well as a bacteria one (known to be implied in accelerated corrosion of steel) during 15 weeks. Testing parameters were selected to accelerate corrosion in order to observe the relative behavior of the present steel grade as compared to traditional piling carbon steel as well as to the known marine grade steel of GB 2 392 919. These tests revealed that the present steel shows, in both environments, a corrosion pattern comparable to that of the marine steel grade of GB 2 392 919, both exhibiting improved corrosion resistance over carbon steel.

For the sake of completion, steel samples made from present steel were exposed in a harbor environment at the low water and immersion levels. After 8 months exposure, mass loss measurements confirmed an improved corrosion resistance of the present steel as compared to conventional carbon steel.

From the above experiments it appears that the present steel allows the manufacture of the various components required for a combined wall, namely sheet piles, tubes and connectors that exhibit mechanical performances superior to those prescribed by the relevant standards and have an improved resistance to corrosion in marine environment.

In the above examples, sheet piles and tubes have been successfully produced from the same cast and thus have substantially identical chemical composition. This will avoid effects of galvanic corrosion when they are used together in a wall.

The invention claimed is:

1. A hot rolled steel sheet pile for marine applications, made of a steel comprising by weight percent:

Carbon: 0.05 to 0.20;
Silicon: 0.15 to 0.55;
Manganese: 0.60 to 1.60;
Chromium: 0.75 to 1.50;
Aluminum: 0.40 to 0.80;
Niobium and/or vanadium: 0.01≤[Nb]+[V]≤0.60;
Sulphur: up to 0.045;
Phosphorus: up to 0.045;
Molybdenum: 0 to 0.15;
Titanium: 0 to 0.05; and
Nitrogen: not more than 0.005;

wherein the balance is iron and incidental and/or residual impurities.

2. The sheet pile of claim 1, product is a piling product which is at least partially immersed in seawater.

3. The sheet pile of claim 1, wherein the carbon content is from 0.06 to 0.10 wt. %.

4. The sheet pile of claim 1, wherein the silicon content is from 0.16 to 0.45 wt. %.

5. The sheet pile of claim 1, wherein the manganese content is from 0.70 to 1.20 wt. %.

6. The sheet pile of claim 1, wherein the chromium content is from 0.80 to 1.20 wt. %.

7. The sheet pile of claim 1, wherein the aluminum content is from 0.40 to 0.70 wt. %.

8. The sheet pile of claim 1, wherein the content on niobium and/or vanadium is defined by: 0.01≤[Nb]+[V]≤0.20 wt. %.

9. The product sheet pile of claim 1, wherein the sulphur content is no more than 0.008 wt. %; and the phosphorous content is no more than 0.020 wt. %.

10. The product sheet pile of claim 1, wherein the steel comprises not more than 0.004 wt. % nitrogen.

11. The sheet pile of claim 1, wherein the steel has a carbon equivalent value (CEV) of less than 0.43 as calculated according to the formula:

$$CEV = C + \frac{Mn}{6} + \frac{Cr + Mo + V}{5} + \frac{Ni + Cu}{15}.$$

12. The sheet pile of claim 1, which is a sheet pile having a minimum yield stress of 355 MPa and a minimum tensile strength of 480 MPa.

13. The sheet pile of claim 1, showing a minimum fracture toughness of 27 J at 0° C.

14. A combined sheet piling wall for marine applications comprising sheet piles as claimed in claim 1 and king piles made of a steel comprising by weight percent;

Carbon: 0.05 to 0.20;
Silicon: 0.15 to 0.55;
Manganese: 0.60 to 1.60;
Chromium; 0.75 to 1.50;
Aluminum: 0.40 to 0.80;
Niobium and/or vanadium: 0.01≤[Nb]+[V]≤0.60;
Sulphur: up to 0.045;
Phosphorus: up to 0.045;
Molybdenum: 0 to 0.15;
Titanium: 0 to 0.05;

wherein the balance is iron and incidental and/or residual impurities.

15. The combined sheet piling wall as claimed in claim 14, which is at least partially immersed in seawater.

16. The combined sheet piling wall as claimed in claim 14, further comprising hot-roiled connectors interconnecting said sheet piles with said king piles, wherein said hot-rolled connectors are made of a steel comprising by weight percent:

Carbon: 0.05 to 0.20;
Silicon: 0.15 to 0.55;
Manganese: 0.60 to 1.60;
Chromium: 0.75 to 1.50;
Aluminum: 0.40 to 0.80;
Niobium and/or vanadium: 0.01≤[Nb]+[V]≤0.60;
Sulphur: up to 0.045;
Phosphorus: up to 0.045;

Molybdenum: 0 to 0.15;
Titanium: 0 to 0.05;
Nitrogen: not more than 0.005;
wherein the balance is iron and incidental and/or residual impurities.

17. The combined sheet piling wall as claimed in claim 14, wherein said king piles comprise wide-flange beams.

18. The combined sheet piling wall as claimed in claim 14, wherein said king piles are cold-formed welded tubes manufactured from steel coils.

19. A set of steel piling products to be interconnected for building a combined sheet piling wall for marine applications, comprising:
sheet piles as claimed in claim 1;
king piles; and
hot-rolled connectors for interconnecting the sheet piles and the king piles;
wherein the king piles and connectors are made of the same steel as the sheet piles.

20. The set of steel piling products as claimed in claim 19, wherein the king piles are wide flange beams.

21. The set of steel piling products as claimed in claim 19, wherein the king piles are cold-formed welded tubes manufactured from steel coils.

22. A hot rolled connector interconnecting sheet piles and king piles in combined walls in marine applications, made of a steel comprising by weight percent:
Carbon: 0.05 to 0.20;
Silicon: 0.15 to 0.55;
Manganese: 0.60 to 1.60;
Chromium: 0.75 to 1.50;
Aluminum: 0.40 to 0.80;
Niobium and/or vanadium: $0.01 \leq [Nb]+[V] \leq 0.60$;
Sulphur: up to 0.045;
Phosphorus: up to 0.045;
Molybdenum: 0 to 0.15;
Titanium: 0 to 0.05;
Nitrogen: not more than 0.005;
wherein the balance is iron and incidental and/or residual impurities.

* * * * *